US006805417B2

(12) United States Patent
Kocienski

(10) Patent No.: US 6,805,417 B2
(45) Date of Patent: Oct. 19, 2004

(54) TOOL BOX DRAWING TABLE

(76) Inventor: Adam Kocienski, 15 Jenna La., Schaghticoke, NY (US) 12154

( * ) Notice: Subject to any disclaimer, the term of this patent is extended or adjusted under 35 U.S.C. 154(b) by 54 days.

(21) Appl. No.: 10/151,125

(22) Filed: May 18, 2002

(65) Prior Publication Data

US 2003/0214206 A1 Nov. 20, 2003

(51) Int. Cl.[7] ..... A47B 77/10
(52) U.S. Cl. ..... 312/314; 312/317.3
(58) Field of Search ..... 312/313, 314, 312/315, 316, 317.1, 317.2, 317.3, 902, 235.4, 237, 281, 282, 249.12, 249.13; 108/6, 48, 134, 118, 152

(56) References Cited

U.S. PATENT DOCUMENTS

| | | | | | |
|---|---|---|---|---|---|
| 920,343 | A | | 5/1909 | Kelly et al. | |
| 1,207,268 | A | * | 12/1916 | Blanchard | 108/39 |
| 1,213,832 | A | * | 1/1917 | Brandt | 312/314 |
| 1,700,545 | A | * | 1/1929 | Wallace | 312/241 |
| 1,949,845 | A | | 3/1934 | Shingle | |
| 2,190,498 | A | * | 2/1940 | Williams | 312/243 |
| 2,619,395 | A | | 11/1952 | Kent | |
| 2,814,892 | A | | 12/1957 | Larsen | |
| D182,926 | S | | 5/1958 | Roeder | |
| 3,031,782 | A | | 5/1962 | Frye | |
| 3,088,127 | A | | 5/1963 | Eames | |
| 3,201,186 | A | * | 8/1965 | Noonan et al. | 312/241 |
| 4,310,207 | A | * | 1/1982 | Adams, Jr. | 312/314 |
| 4,375,306 | A | * | 3/1983 | Linder | 312/249.9 |
| 4,640,326 | A | | 2/1987 | Hewitt | |
| 4,856,435 | A | | 8/1989 | Larson | |
| 4,893,885 | A | | 1/1990 | Borello | |
| 4,919,498 | A | * | 4/1990 | Turner | 312/241 |
| 5,497,878 | A | | 3/1996 | Sandonato | |
| 5,951,129 | A | | 9/1999 | Stein | |
| 6,039,416 | A | * | 3/2000 | Lambert | 312/245 |
| 6,435,634 | B1 | * | 8/2002 | Webb et al. | 312/313 |

FOREIGN PATENT DOCUMENTS

| | | | | |
|---|---|---|---|---|
| FR | 1105512 | * | 12/1955 | 312/313 |

* cited by examiner

*Primary Examiner*—James O. Hansen
(74) *Attorney, Agent, or Firm*—Schmeiser, Olsen & Watts

(57) ABSTRACT

A method and structure to attach a table to a tool box. A table is pivotally attached to a first side of a tool box. An adjustable brace mechanism is used to support the table at a plurality of angular levels with respect to the first side of the tool box.

16 Claims, 8 Drawing Sheets

TOOL BOX DRAWING TABLE

BACKGROUND OF THE INVENTION

1. Technical Field

The present invention relates to an apparatus and associated method to pivotally attach a table assembly to a tool box or another type of structure.

2. Related Art

Viewing drawings such as blueprints or schematics at a job site typically requires a table so that the drawings may be spread out. The level of a table is not typically adjustable and a table may not be portable. Therefore there is a need for an adjustable and portable table so that drawings may be used at a work site.

SUMMARY OF THE INVENTION

The present invention provides a tool box structure, comprising:

a table, a pivot device attached to a side of the table, wherein the pivot device is adapted to attach the side of the table to a first side of a tool box; and an adjustable brace mechanism coupled to the table, wherein the adjustable brace mechanism is adapted to support the table at a plurality of angular levels with respect to the first side of the tool box.

The present invention provides a method for forming a tool box structure, comprising:

providing a table, attaching a pivot device to a side of the table, wherein the pivot device is adapted to attach the side of the table to a first side of a tool box; and coupling an adjustable brace mechanism to the table, wherein the adjustable brace mechanism is adapted to support the table at a plurality of angular levels with respect to the first side of the tool box.

DETAILED DESCRIPTION OF THE INVENTION

Figure 1:
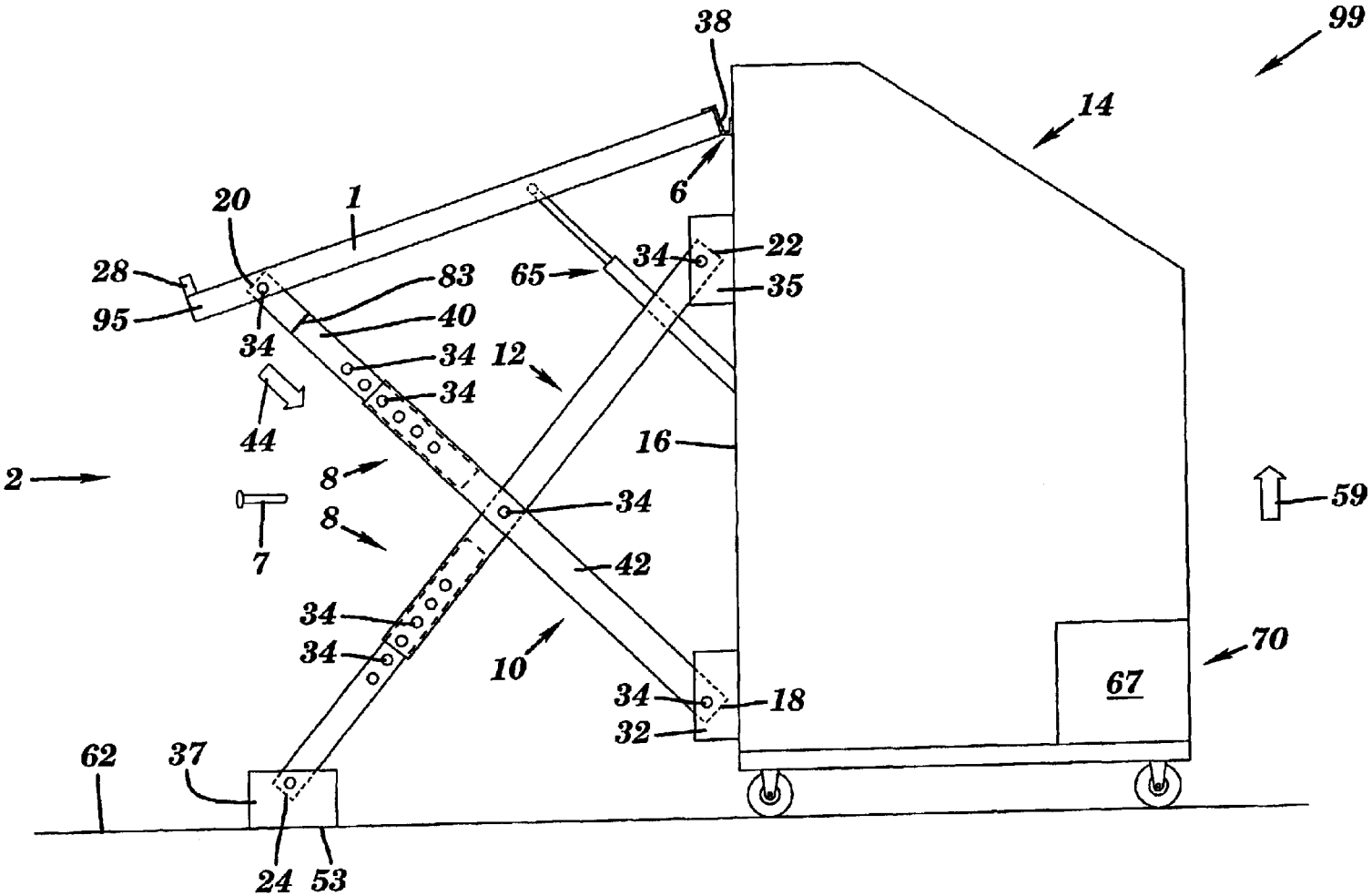
FIG. 1 depicts a view of a tool box attachment structure, in an open working position, pivotally attached to a tool box, in accordance with embodiments of the present invention.
Figure 3:
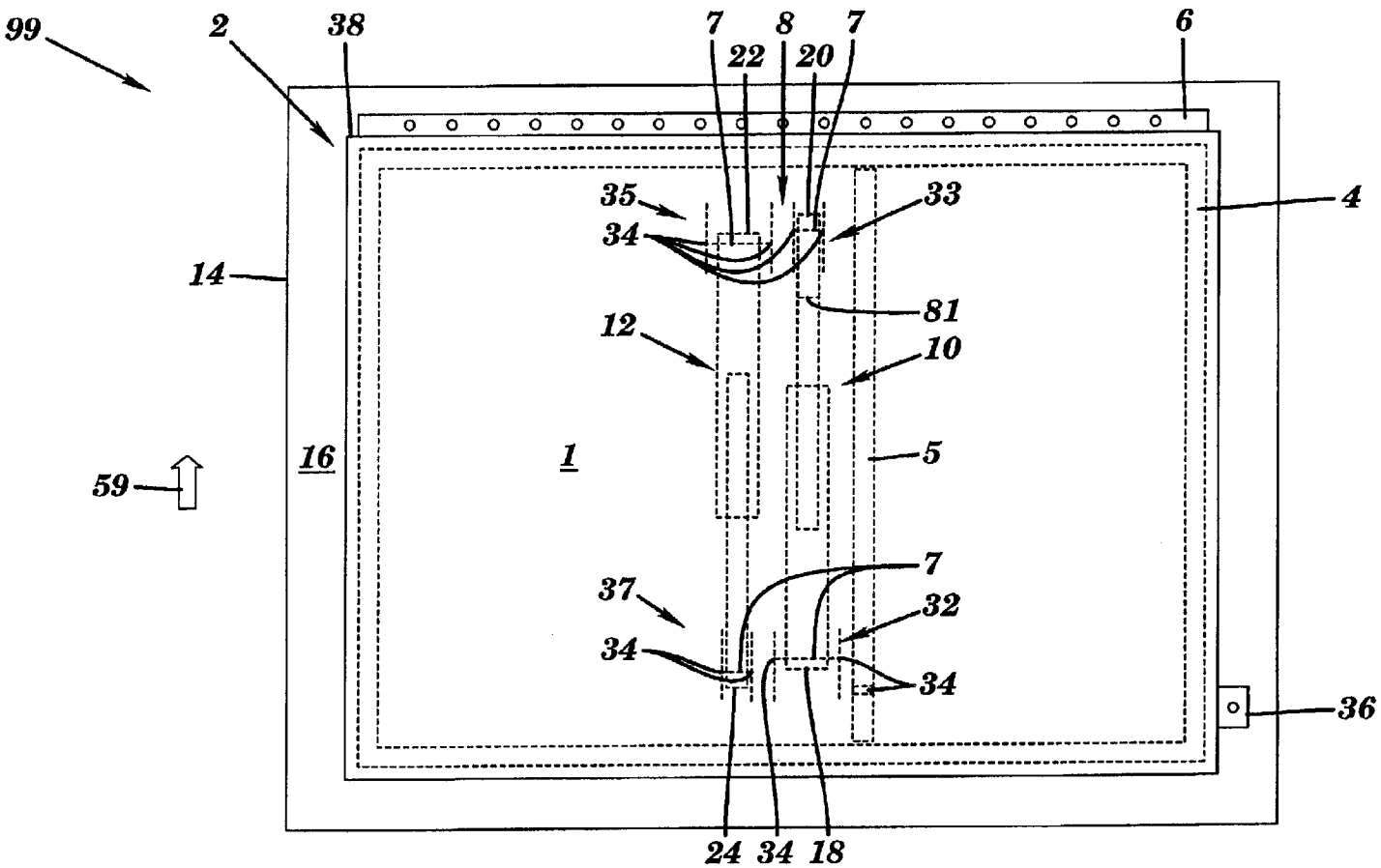
FIG. 3 depicts a view of a tool box attachment structure, in a storage position, pivotally attached to a tool box, in accordance with embodiments of the present invention.
Figure 7:
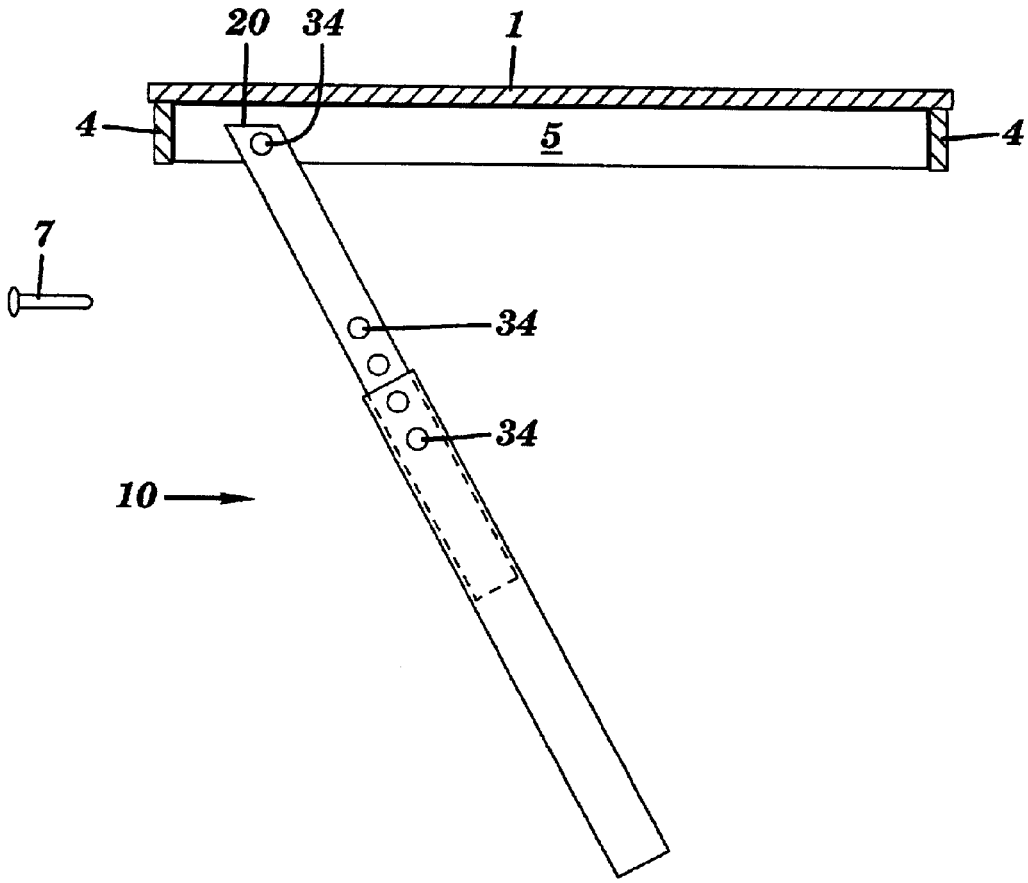
FIG. 7 depicts a view of an adjustable brace pivotally attached to a frame, in accordance with embodiments of the present invention.
Figure 8:
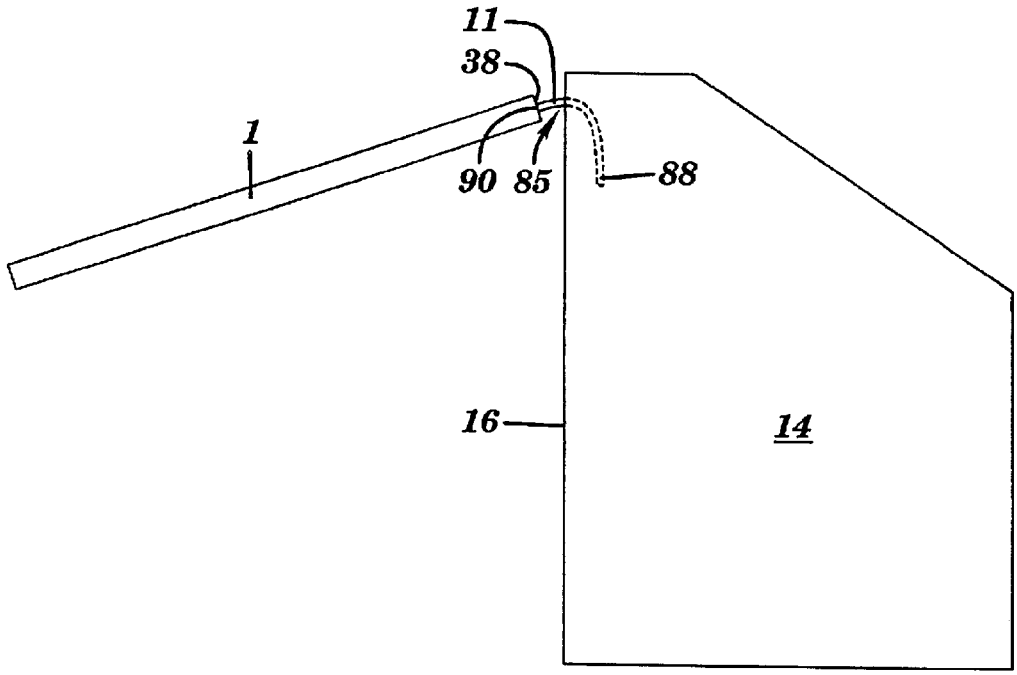
FIG. 8 depicts a view of a tool box attachment structure, pivotally attached to a tool box using a hook, in accordance with embodiments of the present invention.

FIG. 1 illustrates a view of a tool box structure 99 comprising a tool box attachment structure 2 and a tool box 14 wherein the tool box attachment structure 2 is adapted to be pivotally attached to a tool box 14, in accordance with embodiments of the present invention. As an alternative the tool box attachment structure 2 may be attached to a structure other than a tool box such as, inter alia, a wall. The tool box attachment structure 2 shown in FIG. 1 is in an open working position. The tool box attachment structure 2 comprises a table 1, a pivot device 6, and a brace mechanism 8. The table 1 may be used as a surface to view working drawings, such as schematics or blueprints. The table 1 may comprise a flat surface mounted on a frame 4 and a frame 5 (i.e., as shown in FIG. 3). The table 1 may comprise a metallic alloy or metal including, inter alia, steel or aluminum. Alternatively the table 1 may comprise plastic or wood. A piece of wood that is larger than the table 1 may be placed on the surface of the table 1 to create a larger surface area. The pivot device 6 is attached to a first side 38 of the table 1. The pivot device 6 pivotally attaches the first side 38 of the table 1 to a first side 16 of the tool box 14. The pivot device 6 may be a hinge or a plurality of hinges. The hinge may include, inter alia, a piano hinge. The pivot device 6 may be a hook 11 as shown in FIG. 8. The pivot device 6 may comprise a metallic alloy or metal. The adjustable brace mechanism 8 may comprise a first adjustable brace 10 and a second adjustable brace 12. The first adjustable brace 10 may comprise a first elongated member 40 slidably received within a second elongated member 42. The first elongated member 40 may move in the direction 44 to decrease the length of the first adjustable brace 10 and opposite the direction 44 to increase the length of the first adjustable brace 10. A pin 7 may be placed in a hole 34 to rigidly attach the first elongated member 40 to the second elongated member 42 thereby setting a specific length for the first adjustable brace 10. Likewise the second adjustable brace 12 may be the same as the first adjustable brace 10. The first adjustable brace 10 may be used to support the table 1 at a plurality of angular levels with respect to the first side 16 of the tool box 14. A shock absorber device 65 may be placed between the table 1 and the first side 16 of the tool box 14 to assist with the raising of the table 1 to a specific angular level. The shock absorber device 65 may include, inter alia, a gas charged shock assist. A blocking device 28 may be placed on a section 95 of the table 1 to prevent items from sliding off the table 1. A track 32 may be attached to the first side 16 of the tool box 14. A first end 18 of the first adjustable brace 10 may be pivotally attached to the track 32 by placing the pin 7 in the hole 34. As an alternative a hinge may be used to pivotally attach the first end 18 of the first adjustable brace 10 to the first side 16 of the tool box 14. A second end 20 of the first adjustable brace 10 may be pivotally attached to the frame 5 as shown in FIG. 7, thereby supporting the table 1. The second adjustable brace 12 may be used to provide support between the first side 16 of the tool box 14 and the ground 62. A track 35 may be attached to the first side 16 of the tool box 14 at level that is higher with respect to the direction 59 than the level of the track 32. A first end 22 of the second adjustable brace 12 may be pivotally attached to the track 35 by placing the pin 7 in the hole 34. As an alternative a hinge may be used to pivotally attach the first end 22 of the second adjustable brace 12 to the first side 16 of the tool box 14. A second end 24 of the second adjustable brace 12 may be pivotally attached to a track 37 by placing the pin 7 in the hole 34. The second adjustable brace 12 may be extended so that a side 53 of the track 37 makes contact with the ground 62. The first adjustable brace 10 and the second adjustable brace 12 may be pivotally attached to each other. As an alternative the second adjustable brace 12 may be omitted if a counter weight 67 is placed on a section 70 of the tool box 14. Alternatively a plurality of adjustable braces may be used in various locations to support the table 1. The first adjustable brace 10 and the second adjustable brace 12 may comprise a metallic alloy or metal including, inter alia, steel or aluminum. The pin 7 may include, inter alia, a spring pin or a bolt. The pin 7 may comprise metal or plastic.

Figure 2:
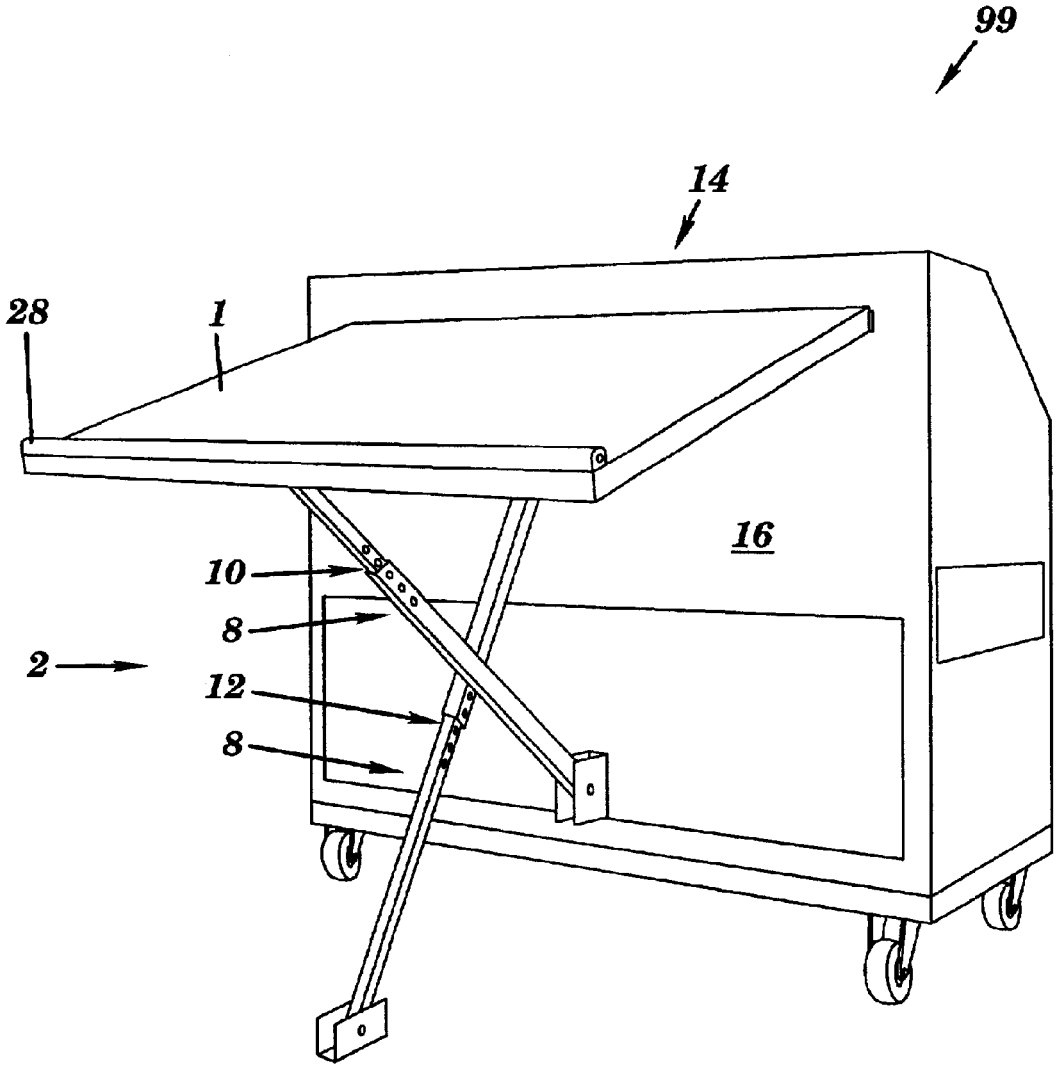
FIG. 2 depicts a perspective view of FIG. 1 showing the tool box attachment structure pivotally attached to the tool box, in accordance with embodiments of the present invention.

FIG. 2 illustrates a perspective view of FIG. 1 showing a tool box attachment structure 2 pivotally attached to a tool box 14, in accordance with embodiments of the present invention. The surface of the table 1 is visible in FIG. 2. The orientation of the brace mechanism 8 with respect to the first side 16 of the tool box 14 is also visible.

FIG. 3 illustrates FIG. 1 in a folded storage position showing a view of the tool box attachment structure 2 pivotally attached to the tool box 14, in accordance with embodiments of the present invention. The tool box attachment structure 2 may comprise a table 1, a pivot device 6, and a brace mechanism 8. The table 1 may comprise a flat surface mounted on a frame assembly 4 and a frame assembly 5. The frame assembly 4 may comprise a plurality of elongated members attached to each other. The plurality of elongated members may be assembled to form different shaped frame assemblies. The frame assembly 5 may be attached to the frame assembly 4. Attachment methods may include, inter alia, welding. The table 1, the frame assembly 4, and frame assembly 5 may each comprise a metallic alloy or metal including, inter alia, steel or aluminum. Alternatively the table 1 may comprise plastic or wood. The pivot device 6 pivotally attaches a first side 38 of the table 1 to a first side 16 of the tool box 14. The pivot device 6 may be a hinge or a plurality of hinges. The hinge may include, inter alia, a piano hinge. The pivot device 6 may comprise a metallic alloy or metal. The adjustable brace mechanism 8 may comprise a first adjustable brace 10 and a second adjustable brace 12. A track 32 may be attached to the first side 16 of the tool box 14. A first end 18 of the first adjustable brace 10 may be pivotally attached to the track 32 by placing a pin 7 in a hole 34. As an alternative a hinge may be used to pivotally attach the first end 18 of the first adjustable brace 10 to the first side 16 of the tool box 14. A track 33 may be attached to the first side 16 of the tool box 14 at a level that is higher than the track 32 with respect to the direction 59. A second end 20 of the first adjustable brace 10 may be pivotally attached to the track 33. The aforementioned attachments of first adjustable brace 10 to the track 32 and the track 33 simultaneously will produce a folded storage position for the first adjustable brace 10. The first adjustable brace 10 will lie flat against the first side 16 of the tool box 14 and parallel to the first side 16 of the tool box 14 in the folded storage position. A track 35 may be attached to the first side 16 of the tool box 14. A first end 22 of the second adjustable brace 12 may be pivotally attached to the track 35 by placing the pin 7 in the hole 34. As an alternative a hinge may be used to pivotally attach the first end 22 of the second adjustable brace 12 to the first side 16 of the tool box 14. A track 37 may be attached to the first side 16 of the tool box 14 at level that is lower with respect to the direction 59 than the level of the track 35. A second end 24 of the second adjustable brace 12 may be pivotally attached to a track 37 by placing the pin 7 in the hole 34. The aforementioned attachments of second adjustable brace 12 to the track 35 and the track 37 simultaneously will produce a folded storage position for the second adjustable brace 12. The second adjustable brace 12 will lie flat against the first side 16 of the tool box 14 and parallel to the first adjustable brace 10 in the folded storage position. The adjustable brace mechanism 8 will be in a folded storage position when the first adjustable brace 10 and the second adjustable brace 12 are simultaneously in the folded storage position. The tool box attachment structure 2 will be in a folded storage position when the table 1 is placed over the adjustable brace mechanism 8 in the folded storage position as shown in FIG. 2. The table 1 may be parallel to the first side of the tool box when the table 1 is in a folded storage position. The table 1 may be locked in place to prevent the tool box attachment structure 2 from moving or opening when in the folded storage position. The table 1 may be locked in place by attaching a latch mechanism 36 to the table 1 and securing it to the tool box 14. A collar 81 may be placed on the first adjustable brace 10 to prevent the first adjustable brace 10 from fully collapsing. The collar 81 may comprise a weld bead. The first adjustable brace 10 and the second adjustable brace 12 may comprise a metallic alloy or metal including, inter alia, steel or aluminum. The pin 7 may include, inter alia, a spring pin or a bolt. The pin 7 may comprise metal or plastic.

Figure 4:
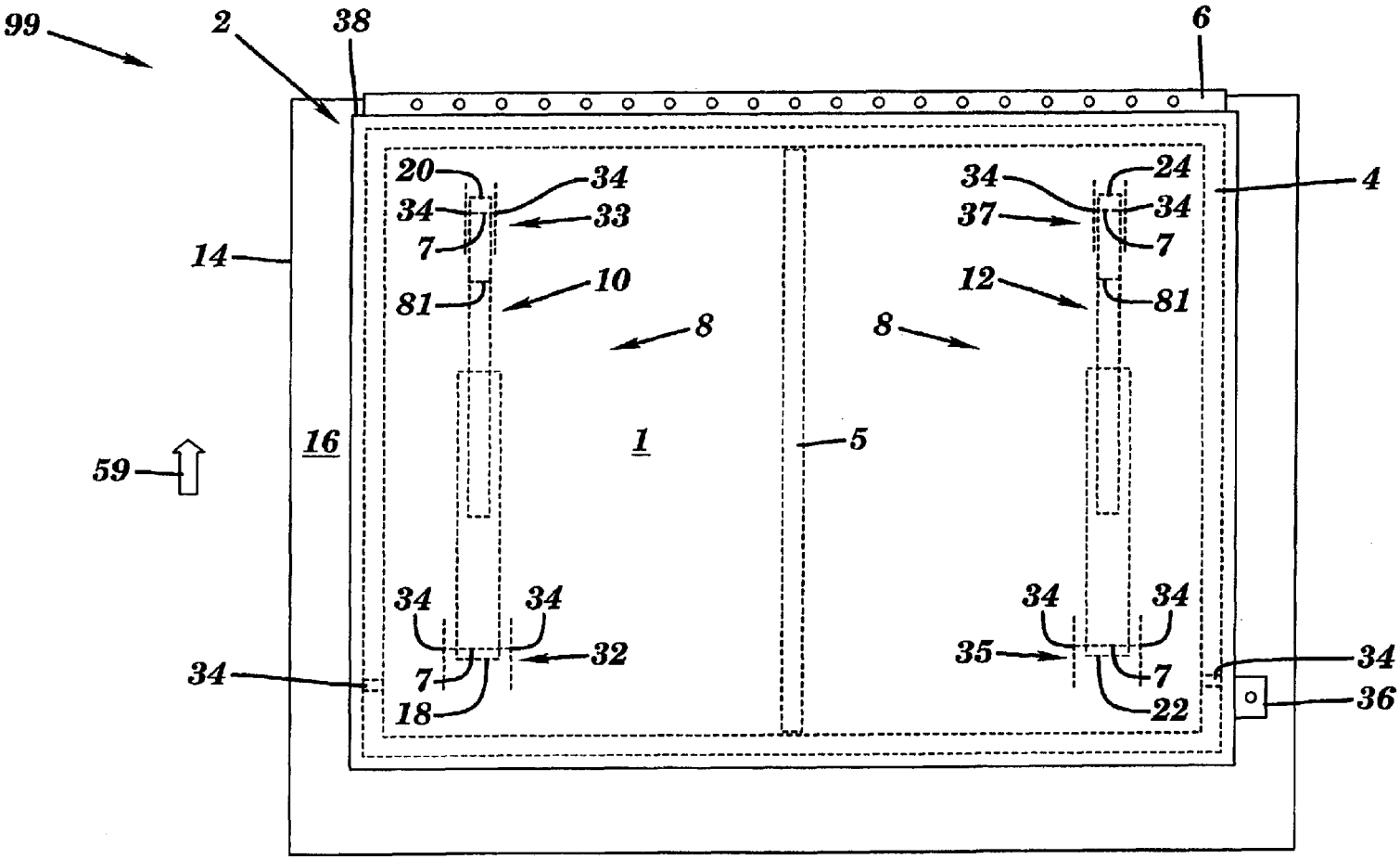
FIG. 4 depicts FIG. 3 using an alternate brace mechanism, in accordance with embodiments of the present invention.

FIG. 4 illustrates a variation of FIG. 3 showing a tool box attachment structure 2 pivotally attached to a tool box 14 in a folded storage position, in accordance with embodiments of the present invention. In contrast with FIG. 2 the first adjustable brace 10 and the second adjustable brace 12 are placed in different locations on the first side 16 of the tool box 14.

Figure 5:
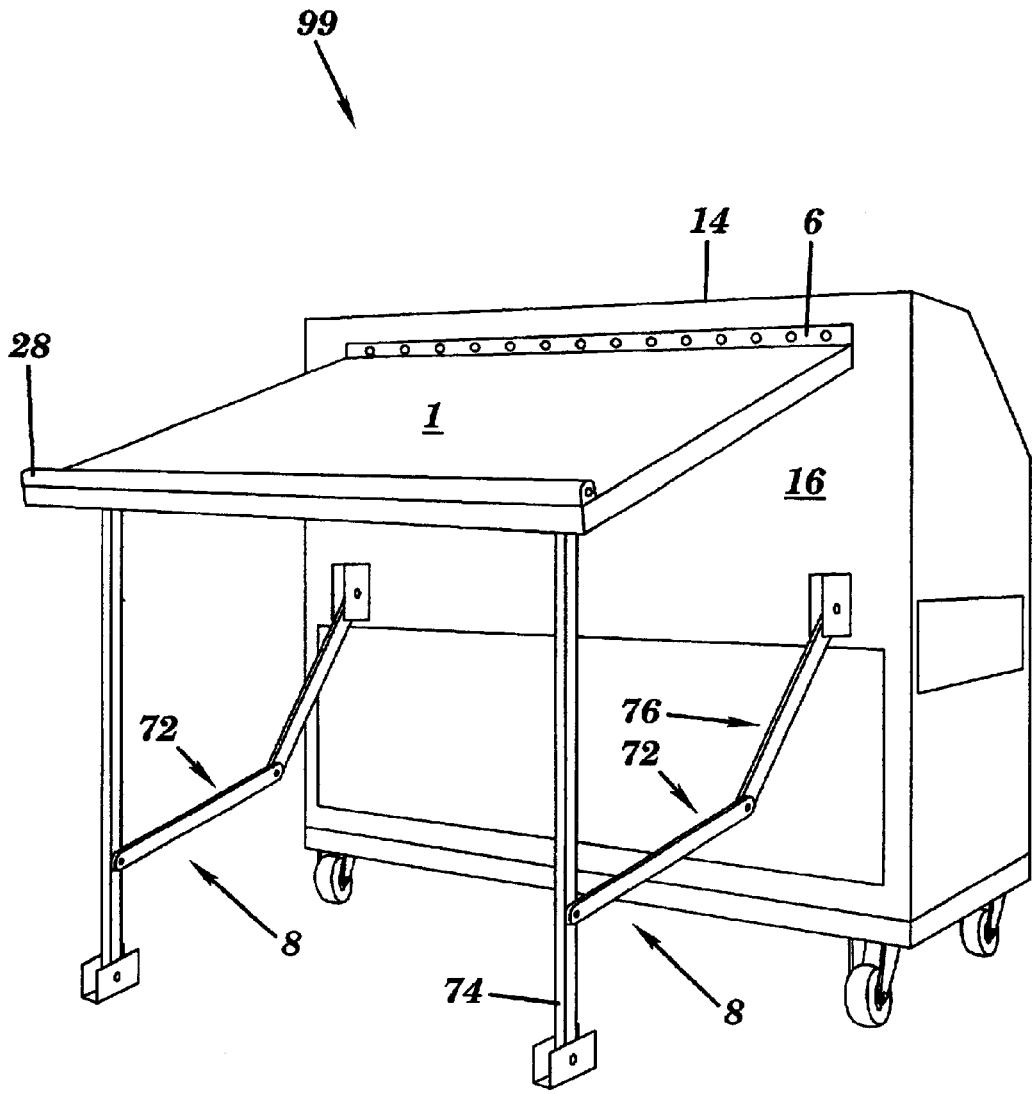
FIG. 5 depicts FIG. 2 using legs for a brace mechanism, in accordance with embodiments of the present invention.
Figure 6:
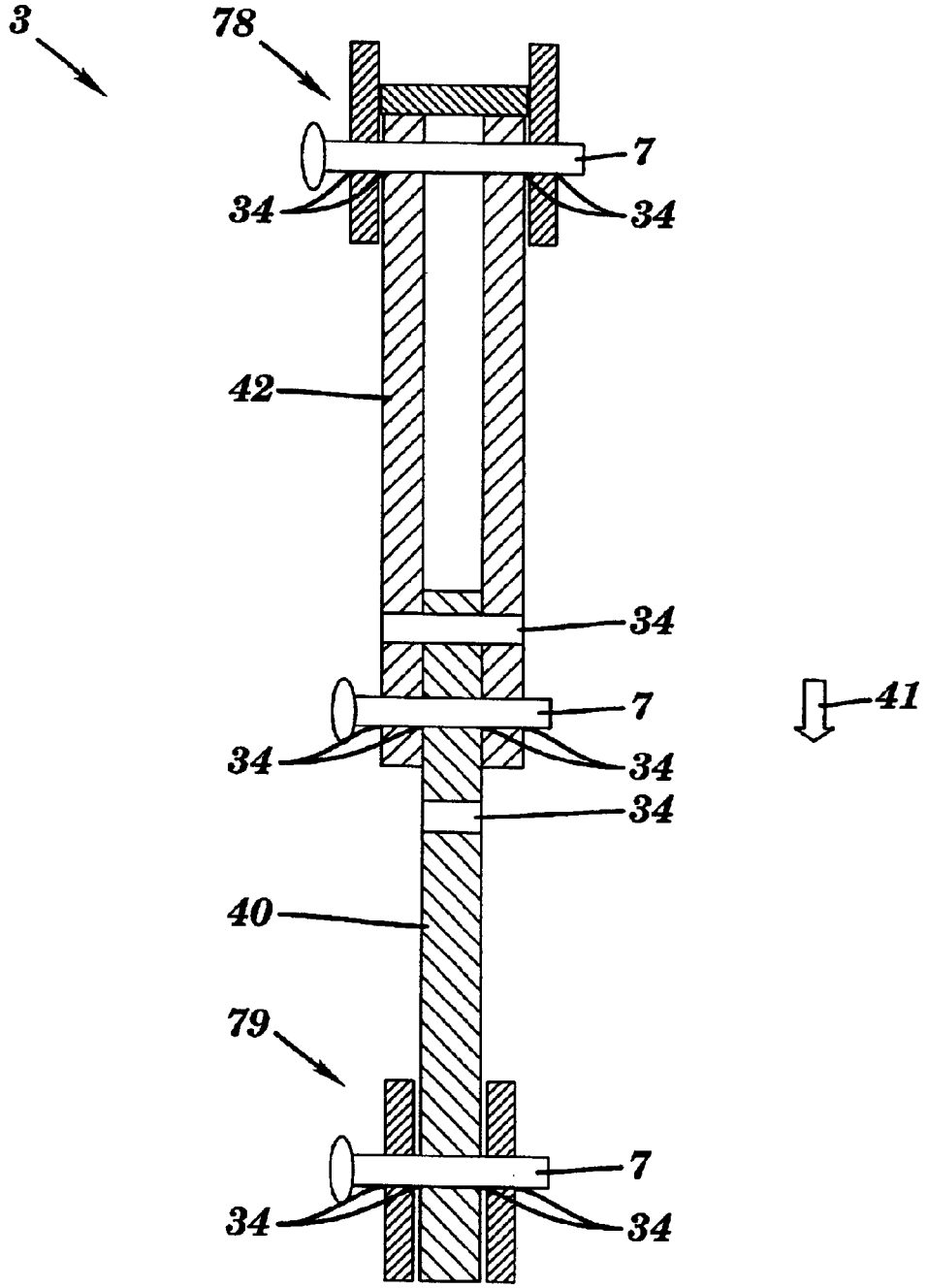
FIG. 6 depicts a view of an adjustable brace, in accordance with embodiments of the present invention.

FIG. 5 illustrates a variation of FIG. 2 showing a view of a tool box attachment structure 2 pivotally attached to a tool box 14, in accordance with embodiments of the present invention. The adjustable brace mechanism 8 comprises two leg assemblies 72 to support the table 1. The leg assembly 72 may comprise a leg 74 and a leg brace 76. The leg assembly 72 may alternatively be an adjustable brace 3 as shown in FIG. 6. A single leg assembly 72 or a plurality of leg assemblies 72 may be used at various locations to support the table 1. A single leg 74 may be used at various locations to support the table 1. A shock absorber device 65 (i.e., as shown in FIG. 1) may be used as a brace between the single leg 74 and a first side 16 the tool box 14.

FIG. 6 illustrates a cross sectional view of an adjustable brace 3 that may be used as the first adjustable brace 10 and the second adjustable brace 12 as shown in FIG. 1. The adjustable brace 3 comprises a first elongated member 40 slidably received within a second elongated member 42. The first elongated member 40 may move in the direction 41 to increase the length of the adjustable brace 3 and opposite to the direction 41 to decrease the length of the adjustable brace 3. A pin 7 may be placed in a hole 34 to rigidly attach the first elongated member 40 to the second elongated member 42 thereby locking a specific length for the adjustable brace 3. Alternative holes 34 may be lined up with each other (i.e., superimposed) so that different lengths may be locked for the adjustable brace 3. A track 78 and 79 may be pivotally attached to the adjustable brace by using the pin 7. The track 78 corresponds to the track 32 and the track 35 in FIG. 2. The track 79 corresponds to the track 33 and the track 37 in FIG. 2.

FIG. 7 illustrates a partial view of FIG. 1 showing the second end 20 of the first adjustable brace 10 pivotally attached to the frame 5. The pin 7 is inserted in the hole 34 to pivotally attach the first adjustable brace 10 to the frame 5. The table 1 is mounted on the frame 4 and the frame 5.

FIG. 8 illustrates an alternative embodiment of FIG. 1 showing a table 1 pivotally attached to a tool box 14, in accordance with embodiments of the present invention. The table 1 is pivotally attached to a side 16 of the tool box 14 using a hook 11. A first end 90 of the hook 11 is attached to a side 38 of the table 1. A second end 88 of the hook 11 goes through a cutout 85 in the first side 16 of the tool box 14 thereby pivotally attaching the table 1 to the tool box 14.

Figure 9:
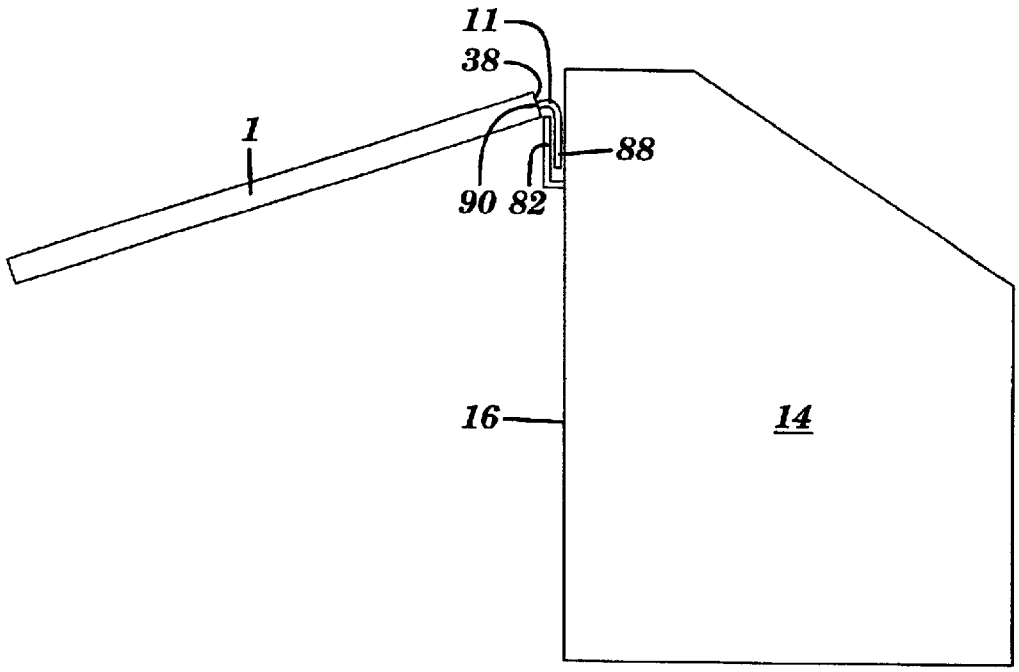
FIG. 9 depicts FIG. 8 using a rail to attach a hook to a tool box, in accordance with embodiments of the present invention.

FIG. 9 illustrates a variation of FIG. 8 showing a table 1 pivotally attached to a tool box 14, in accordance with embodiments of the present invention. In contrast to FIG. 8, the second end 88 of the hook attaches to a rail 82 to pivotally attach the table 1 to the tool box 14.

While embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. A tool box attachment structure, comprising:

a table, a pivot device attached to a side of the table, wherein the pivot device is adapted to attach the side of the table to a first side of a tool box; and an adjustable brace mechanism coupled to the table, wherein the adjustable brace mechanism is adapted to support the table at a plurality of angular levels with respect to the first side of the tool box, wherein the plurality of angular levels comprises at least one angular level that is greater than 0 degrees wherein the adjustable brace mechanism comprises a first adjustable brace and a second adjustable brace, wherein a first end of the first adjustable brace is adapted to be pivotally attached to the first side of the tool box and a second end of the first adjustable brace is adapted to support the table, and wherein a first end of the second adjustable brace is adapted to be pivotally attached to the first side of the tool box and a second end of the second adjustable brace is adapted to support the tool box from a ground surface and less than 90 degrees.

2. The tool box attachment structure of claim 1, further comprising the tool box, wherein the adjustable brace mechanism supports the table at the plurality of angular levels with respect to the first side of the tool box.

3. The tool box attachment structure of claim 1, further comprising the tool box, wherein the pivot device attaches the side of the table to the first side of the tool box.

4. The tool box attachment structure of claim 1, further comprising the tool box, wherein the pivot device attaches the side of the table to the first side of the tool box, and wherein the adjustable brace mechanism supports the table at the plurality of angular levels with respect to the first side of the tool box.

5. The tool box attachment structure of claim 1, wherein the table is adapted to be placed in a folded storage position that is parallel to the first side of the tool box.

6. The tool box attachment structure of claim 1, wherein the table comprises a flat surface mounted on a frame.

7. The tool box attachment structure claim 6, wherein the frame comprises elongated members that are attached to each other to form a shape.

8. The tool box attachment structure of claim 1, wherein the pivot device is a hinge.

9. The tool box attachment structure of claim 1, wherein the pivot device is a piano hinge.

10. The tool box attachment structure of claim 1, wherein the first adjustable brace is adapted to provide support between the tool box and the table, and wherein the second adjustable brace is adapted to provide support between the tool box and a ground surface.

11. The tool box attachment structure of claim 1, wherein the first adjustable brace is pivotally attached to the second adjustable brace.

12. The tool box attachment structure of claim 1, wherein the first adjustable brace has a folded storage position that is parallel to the first side of the tool box.

13. The tool box attachment structure of claim 1, wherein the second adjustable brace has a folded storage position that is parallel to the first side of the tool box.

14. The tool box attachment structure of claim 1, wherein at least one of the first adjustable brace and second adjustable brace comprises a first elongated member slidably received within a second elongated member.

15. The tool box attachment structure of claim 14, wherein the at least one of the first adjustable brace and second adjustable brace comprises at least one pin adapted to rigidly attach the first elongated member to the second elongated member.

16. The tool box attachment structure of claim 1, wherein the table comprises a blocking device mechanically attached to the table, and wherein the blocking device is adapted to prevent items from sliding off of the table.

* * * * *